US006575783B1

(12) United States Patent
Wu

(10) Patent No.: US 6,575,783 B1
(45) Date of Patent: Jun. 10, 2003

(54) ELECTRICAL CONNECTOR ASSEMBLY WITH RETAINING FRAME

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/217,778

(22) Filed: Aug. 12, 2002

(51) Int. Cl.[7] ..... H01R 13/60
(52) U.S. Cl. ..... 439/540.1; 439/717
(58) Field of Search ..... 439/540.1, 637, 439/717, 74, 712, 701

(56) References Cited

U.S. PATENT DOCUMENTS 4,171,862 A * 10/1979 Krasser ..... 439/717
5,876,245 A * 3/1999 Tomita et al. ..... 439/540.1
6,095,824 A * 8/2000 McHugh ..... 439/74

* cited by examiner

*Primary Examiner*—Lynn D. Feild
*Assistant Examiner*—Son V. Nguyen
(74) *Attorney, Agent, or Firm*—Wei Te Chung

(57) ABSTRACT

An electrical connector assembly (1) comprises two electrical connectors (2) and a retaining frame (3). Each electrical connector comprises an insulative housing (4) having an elongated mounting portion (42) and a plurality of conductive terminals (5) received in the housing. The mounting portion has two sidewalls (421) each having a plurality of spaced bar portions (425). A T-shaped space (423) is defined between two neighboring bar portions. An upper recess (426) and a lower recess (428) are defined in a selected bar portion. The retaining frame is rectangular and has two longitudinal sidewalls (30). A plurality of T-shaped protrusions (304) projects from each longitudinal sidewall and is retained in corresponding T-shaped spaces of an adjacent electrical connector. Two projecting legs (306) extend downwardly from each longitudinal sidewall, and each comprises a connection portion (307) facing the upper recess and a projection (308) fitting in the lower recess.

1 Claim, 9 Drawing Sheets

ELECTRICAL CONNECTOR ASSEMBLY WITH RETAINING FRAME

CROSS-REFERENCE TO RELATED APPLICATION

This patent application is a co-pending application of U.S. patent application Ser. No. 10/194,121, entitled "LOW PROFILE ELECTRICAL CONNECTOR HAVING IMPROVED CONTACTS", filed on Jul. 11, 2002, invented by the same inventor and assigned to the same assignee as the present application.

BACKGROUND OF THE INVENTION

1. Field of the Invention

The present invention relates to an electrical connector assembly, and more particularly to a connector assembly with a retaining frame connecting adjacent electrical connectors together.

2. Description of Related Art

Serial Advanced Technology Attachment (Serial ATA) is a high speed interface between storage devices (such as hard disks, floppy drives, CD-ROMs, and DVDs) and a motherboard. The numerous advantages of Serial ATA make it replace Parallel ATA and Ultra ATA interfaces and become the next generation personal computer (PC) storage interface. Correspondingly, Serial ATA connectors have been designed and developed by many companies in the art.

One type of the serial ATA connectors mounted on a printed circuit board (PCB) comprises an insulative housing and a plurality of conductive terminals retained in the housing. Generally, the insulative housing has a long-and-thin profile. The terminals extend downwardly from the housing and are assembled to the PCB by through hole, surface mount or press fit technologies. Whatever way is chosen, the Serial ATA connector may not stand firmly in the insertion or the withdrawal direction of a complementary electrical connector due to its long-and-thin profile. The reliability of electrical performance of the Serial ATA connector, therefore, would be adversely affected.

One solution to the problem stated above is to change the profile of the Serial ATA connector. However, this solution is inapplicable, since the connector profile must conform to the Serial ATA Specification. Considering more storage devices developed, and more Serial ATA connectors being assembled to the PCB, an electrical connector assembly having several Serial ATA connectors joined together is provided to address the problem.

Hence, the present invention aims to provide an electrical connector assembly with a retaining frame connecting adjacent electrical connectors together.

SUMMARY OF THE INVENTION

Accordingly, an object of the present invention is to provide an electrical connector assembly comprising at least two electrical connectors being connected by at least one retaining frame, whereby the connectors can be more firmly secured to a printed circuit board and stably connect with complementary connectors.

In order to achieve the object set forth, an electrical connector assembly in accordance with the present invention comprises at least two electrical connectors and at least one retaining frame. Each connector includes an insulative housing having an elongated mounting portion and a plurality of conductive terminals received in the housing. The mounting portion has two sidewalls each having a plurality of spaced bar portions thereon. A T-shaped space is defined between two neighboring bar portions. An upper recess and a lower recess are defined in a selected bar portion. The retaining frame is rectangular and has two longitudinal sidewalls and two transverse sidewalls connecting the longitudinal sidewalls. A plurality of T-shaped protrusions project outwardly from each longitudinal sidewall and are received into corresponding T-shaped spaces of an adjacent electrical connector. Two projecting legs extend downwardly from each longitudinal sidewall and each comprises a projection fitting into the lower recess of the insulative housing of the adjacent electrical connector.

Other objects, advantages and novel features of the invention will become more apparent from the following detailed description when taken in conjunction with the accompanying drawings.

DETAILED DESCRIPTION OF THE INVENTION

Figure 1:
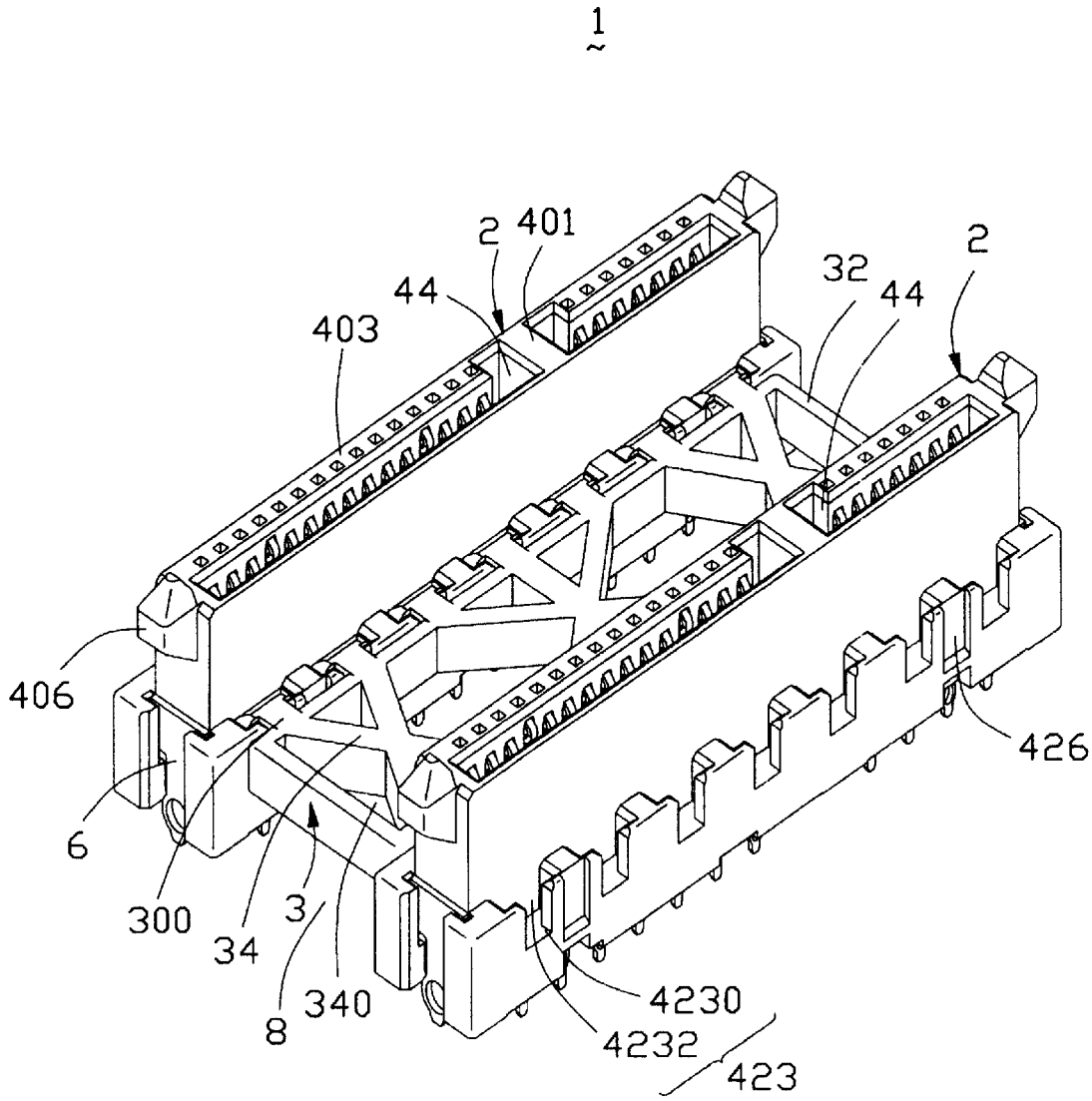
FIG. 1 is a perspective view of an electrical connector assembly in accordance with the present invention.
Figure 2:
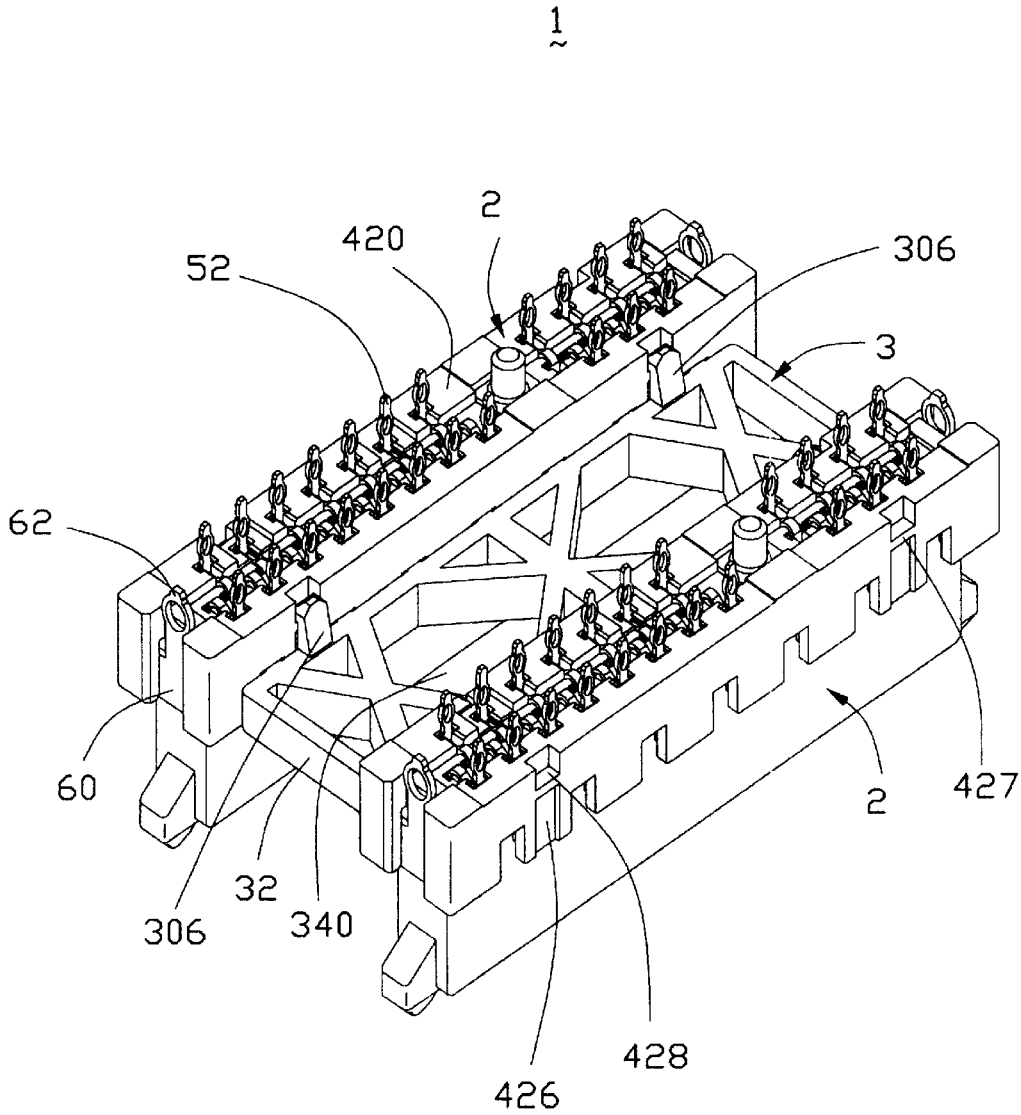
FIG. 2 is a perspective view of the electrical connector assembly of FIG. 1 from a bottom aspect.

An electrical connector assembly 1 in accordance with the present invention comprises at least two electrical connectors and at least one retaining frame. Referring to FIGS. 1–2, in a preferred embodiment of the present invention, two Serial ATA electrical connectors 2 and one retaining frame 3 are shown.

Figure 3:
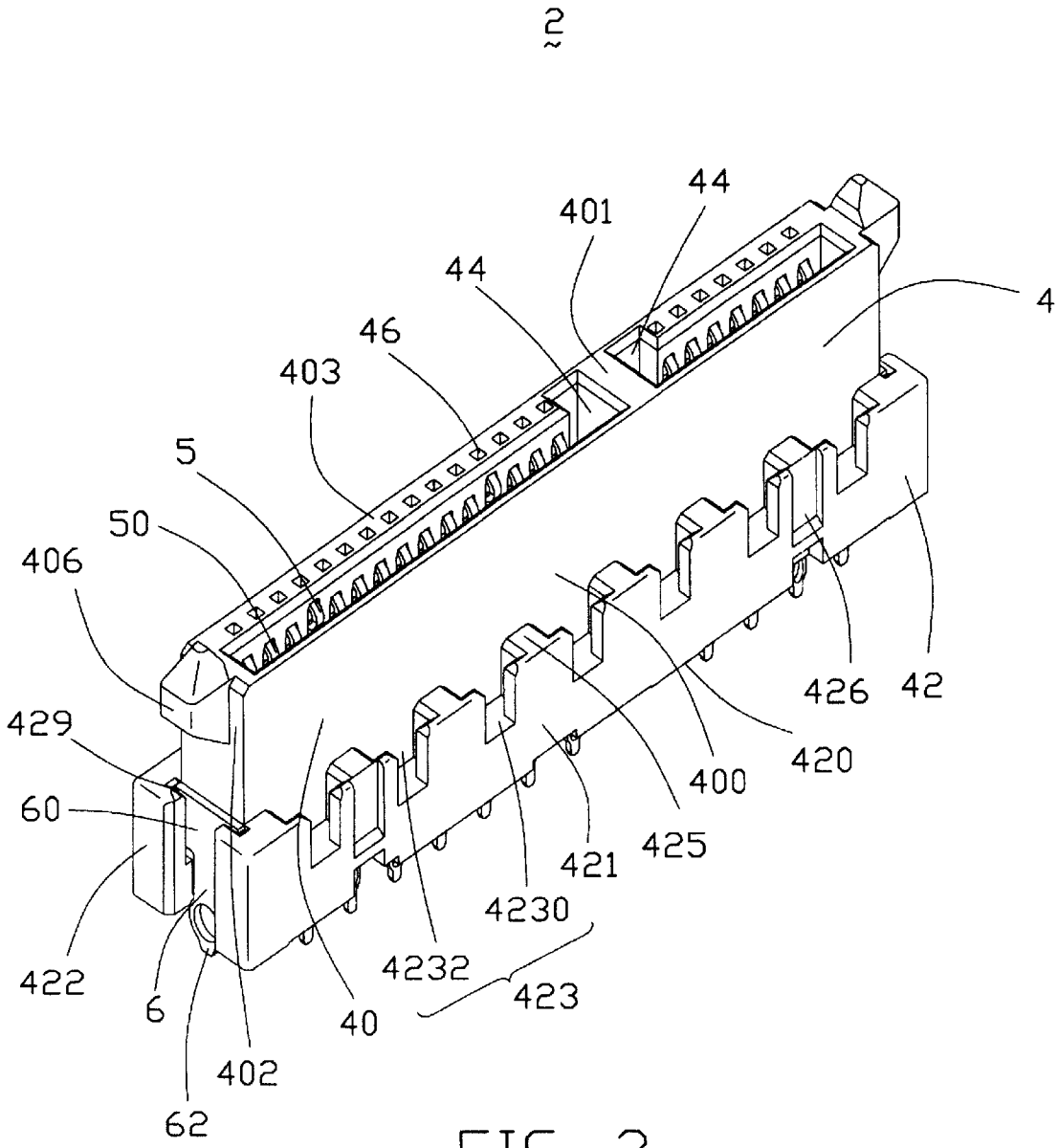
FIG. 3 is a perspective view of an electrical connector of the electrical connector assembly of FIG. 1.
Figure 4:
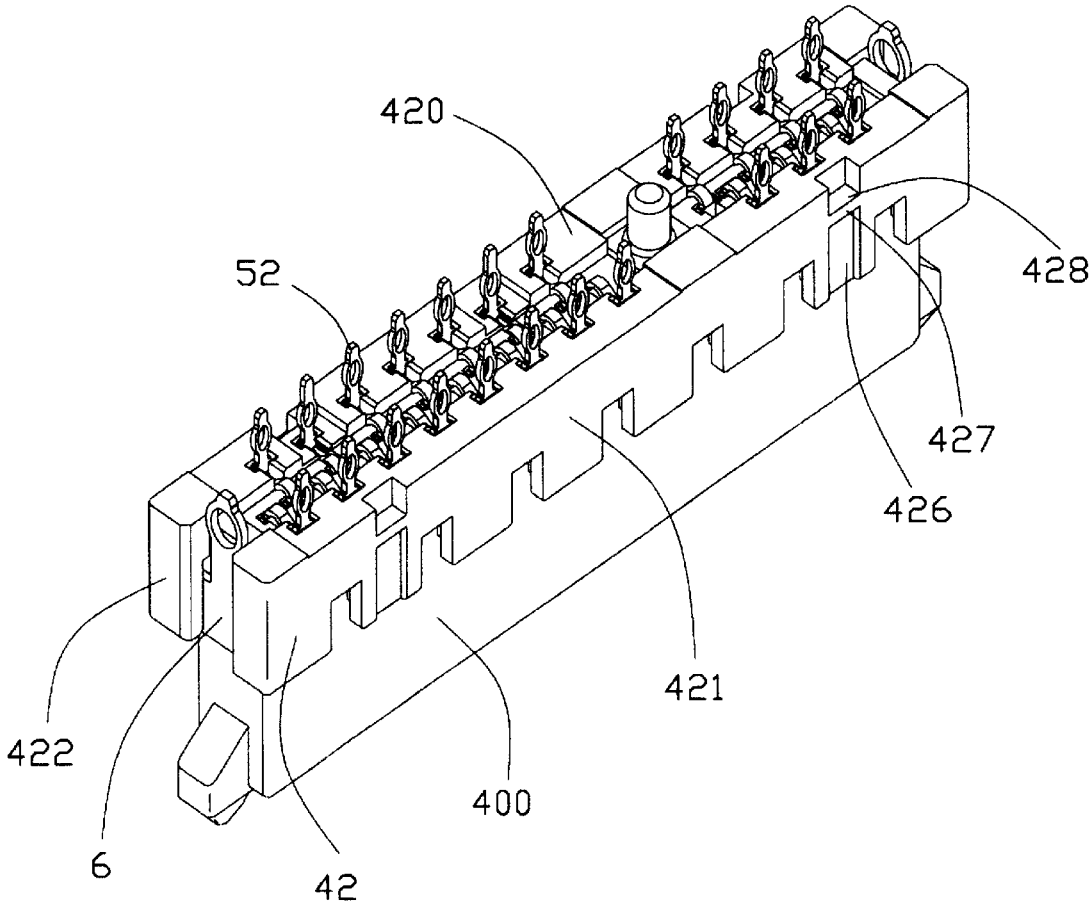
FIG. 4 is a perspective view of the electrical connector of FIG. 3 from a bottom aspect.

With reference to FIGS. 3–4, each electrical connector 2 includes an insulative housing 4, a plurality of conductive terminals 5 and a pair of board locks 6. The insulative housing 4 comprises an elongated mating portion 40 and an elongated mounting portion 42. The mating portion 40 comprises a pair of longitudinal sidewalls 400, a pair of lateral ends 402 connecting opposite ends of the longitudinal sidewalls 400, and an intermediate wall 401 extending parallelly between the lateral ends 402 and connecting with the longitudinal sidewalls 400. The longitudinal sidewalls 400, the lateral ends 402 and the intermediate wall 401 together define two receiving slots 44 therebetween. One of the slots 44 has a longitudinal dimension larger than the other of the slots 44. One of the longitudinal sidewalls 400 is thicker in the lateral direction than the other of the longitudinal sidewalls 400 and defines a plurality of passageways 46 communicating with corresponding receiving slots 44. A guiding block 406 projects longitudinally from an upper section of each lateral end 402 and extends beyond a mating face 403 of the mating portion 40.

The mounting portion 42 of the insulative housing 4 has a mounting face 420 and a pair of longitudinal sidewalls 421 extending upwardly from the mounting face 420. Each sidewall 421 has a pair of lateral ends 422 in the longitudinal direction. A plurality of T-shaped spaces 423 are defined in each longitudinal sidewall 421 of the mounting portion 42 and adjacent to the longitudinal sidewalls 400 of the mating portion 40. Each T-shaped space 423 is composed of a slot 4230 and a channel 4232 communicating with each other. The channel 4232 is wider than the slot 4230 and is located closer to a corresponding sidewall 400. A plurality of bar portions 425 is formed at an upper portion of the sidewalls 421 and connects with the longitudinal sidewalls 400. The T-shaped spaces 423 are defined between every two neighboring bar portions 425. An upper recess 426 and a lower recess 428 are defined in an outer surface (not labeled) of each of the bar portions 425 which are located adjacent to the lateral ends 422. The upper recess 426 and the lower recess 428 have the same width but the upper recess 426 has a vertical dimension larger than the lower recess 428. A partition 427 is formed between the upper recess 426 and the lower recess 428. Each lateral end 422 defines a slit 429.

Figure 8:
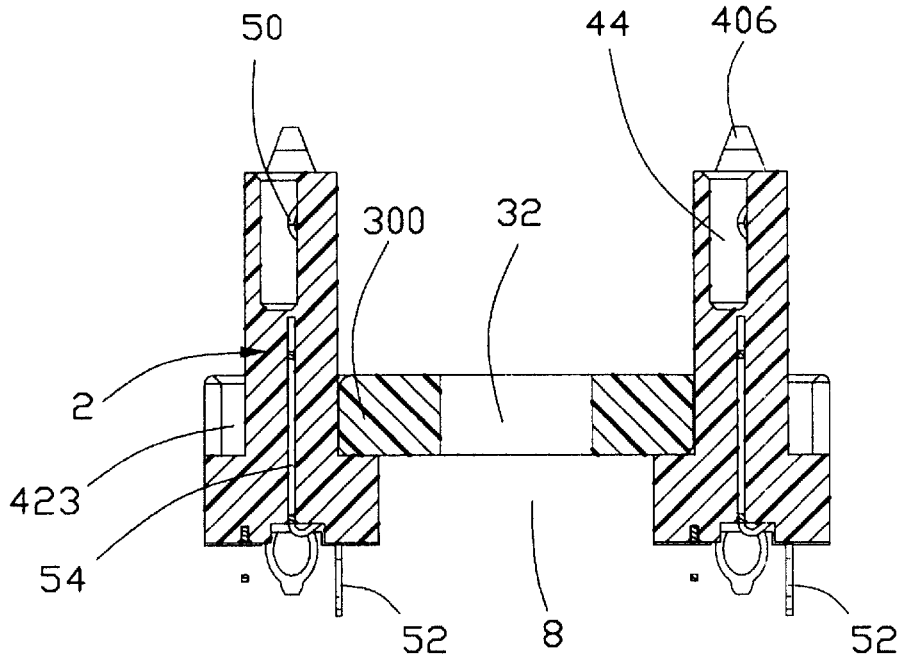
FIG. 8 is a cross-sectional view taken along line 8—8 of FIG. 7.

Each conductive terminal 5 comprises a mating end 50 received in a corresponding passageway 46 and projecting into a corresponding slot 44 for electrically contacting with a mating terminal of a complementary connector (not shown), a press-fit tail 52 extending downwardly from the mounting face 420 for being press fitted into a corresponding plated through hole in a printed circuit board (not shown) on which the electrical connector assembly 1 is mounted, and a connection portion 54 (see FIG. 8) connecting the mating end 50 with the press-fit tail 52. The detailed structure of the conductive terminal 5 is disclosed in Co-pending patent application entitled "LOW PROFILE ELECTRICAL CONNECTOR HAVING IMPROVED CONTACTS", invented by the same inventor as the present application. The disclosure of the Co-pending application is wholly incorporated herein by reference.

Each board lock 6 comprises a body portion 60 and a press-fit tail 62 extending downwardly from the body portion 60.

To assemble the electrical connector 2, the conductive terminals 5 are inserted into the passageways 46 from the mounting face 420 of the insulative housing 4. The body portions 60 of the board locks 6 are received and retained, in an ordinary way known to persons skilled in the related art, in the slits 429 of the mounting portion 42. The press-fit tail 62 of each board lock 6 extends downwardly beyond the mounting face 420 of the insulative housing 4 to be inserted into a corresponding hole in the printed circuit board.

Figure 5:
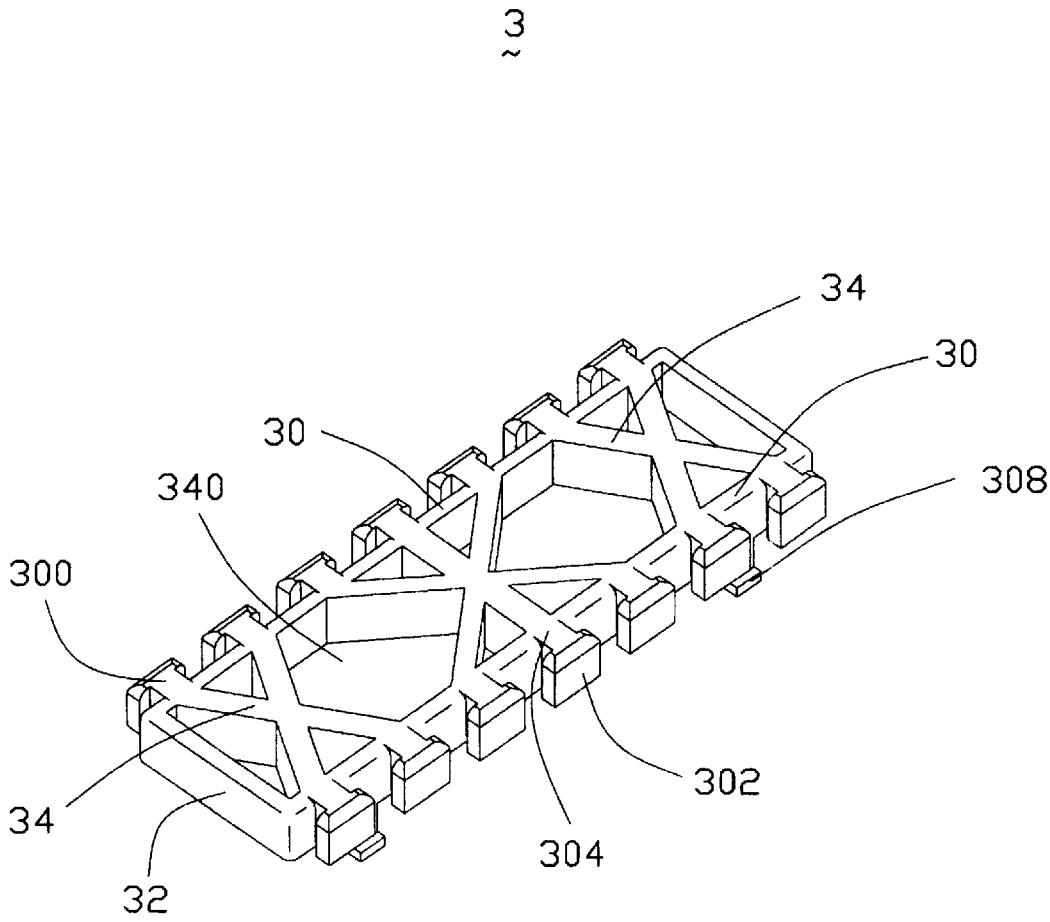
FIG. 5 is a perspective view of a retaining frame of the electrical connector assembly of FIG. 1.
Figure 6:
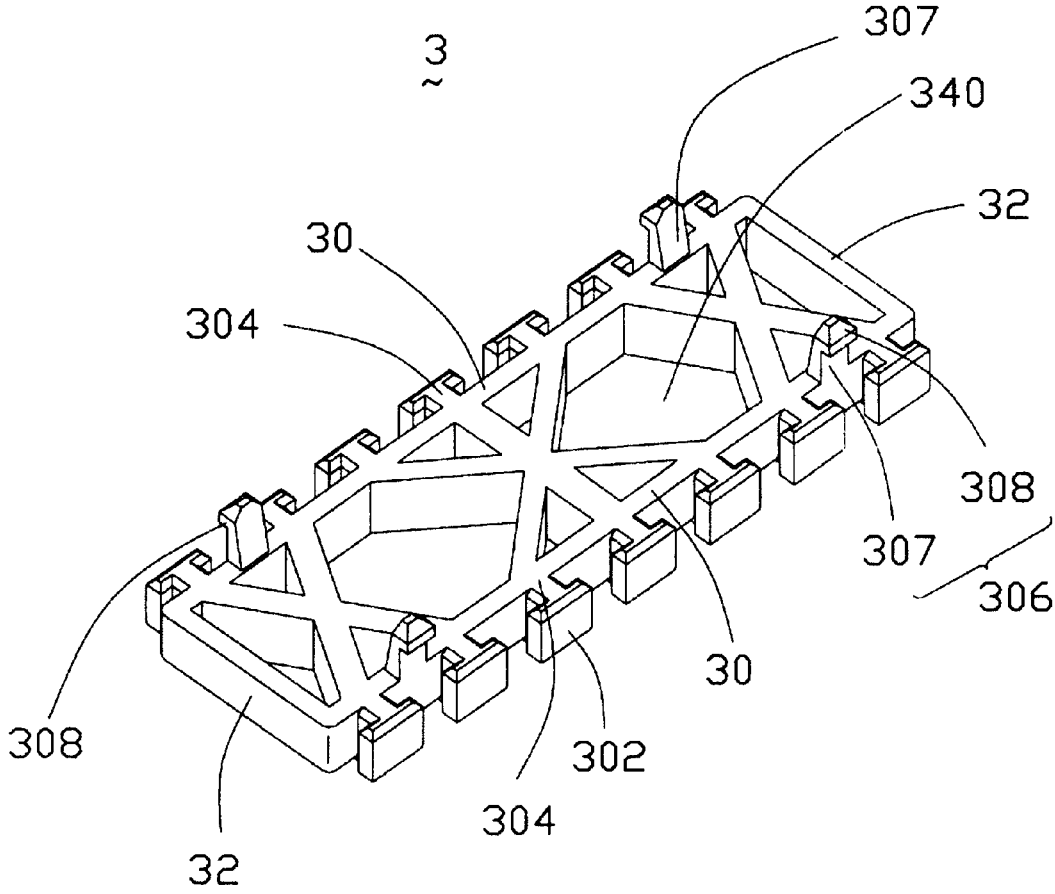
FIG. 6 is a perspective view of the retaining frame of FIG. 5 from a bottom aspect.
Figure 7:
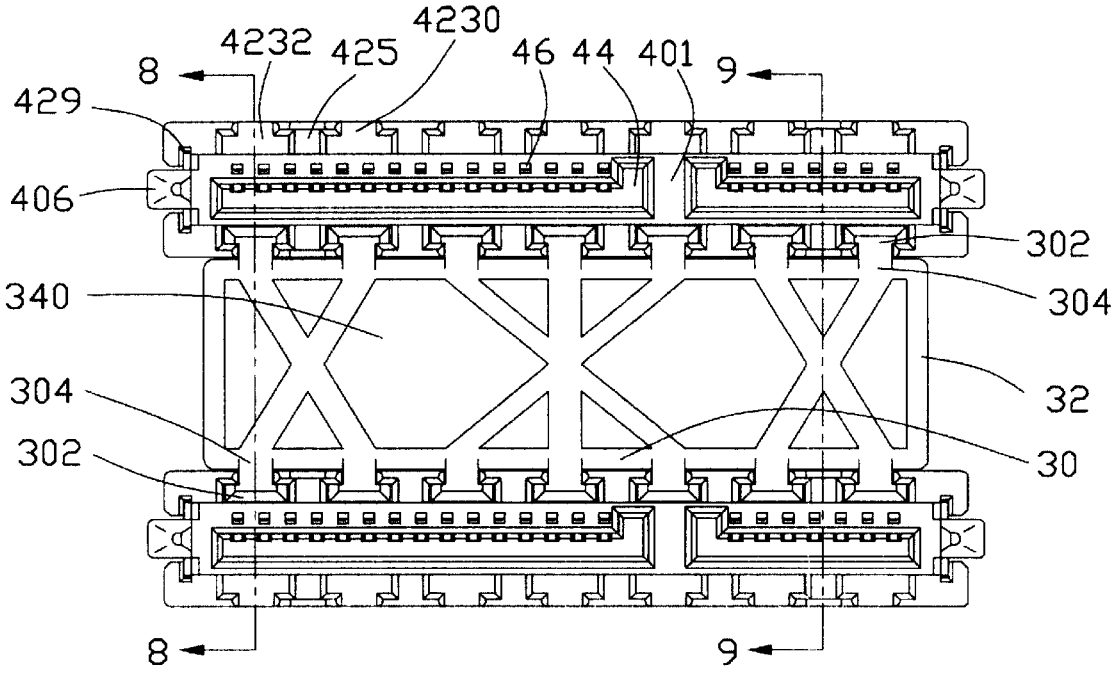
FIG. 7 is a top plan view of the electrical connector assembly of FIG. 1.

The retaining frame 3, shown in FIGS. 5–6, is rectangular and has a pair of longitudinal sidewalls 30 and a pair of transverse sidewalls 32 connecting opposite ends of the longitudinal sidewalls 30. A plurality of cross beams 34 is provided to connect the longitudinal sidewalls 30 together to enhance strength of the retaining frame 3. A plurality of cavities 340 is defined between the beams 34 for heat dissipation. A plurality of T-shaped protrusions 300 projects outwardly from the longitudinal sidewalls 30. Each T-shaped protrusion 300 comprises a platform 302 at a distal end thereof and a connection portion 304 which connects the longitudinal sidewall 30 with the platform 302. The connection portion 304 is narrower than the platform 302 and corresponds to the width of the slot 4230 of the electrical connector 2. A plurality of projecting legs 306 extends downwardly from the longitudinal sidewalls 30. Each projecting leg 306 comprises a projection/lock 308 formed at a lower end and a connection portion 307 which connects the projection 308 with a corresponding longitudinal sidewall 30.

Figure 9:
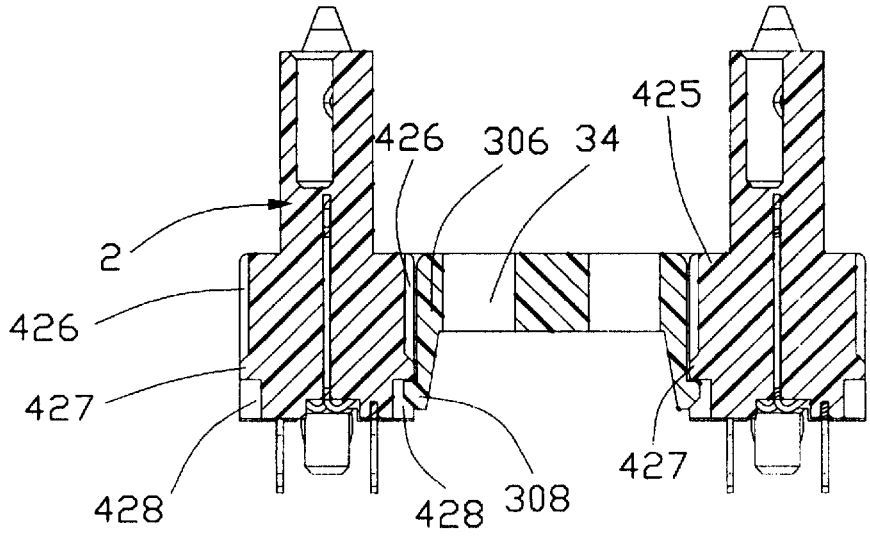
FIG. 9 is a cross-sectional view taken along line 9—9 of FIG. 7.

Referring particularly to FIGS. 1, 2, 7, 8 and 9, in assembly, the retaining frame 3 is attached to the electrical connectors 2, with the longitudinal sidewalls 30 respectively abutting against neighboring sidewalls 421 of the electrical connectors 2. The platform 302 of each T-shaped protrusion 300 is retained in the channel 4232 of each T-shaped space 423 between two adjacent bar portions 425. The connection portion 304 of each T-shaped protrusion 300 fits in a corresponding slot 4230 of the T-shaped space 423. Simultaneously, as shown in FIG. 9, each projecting leg 306 is guided along the upper recess 426 of the bar portion 425, and the projection 308 of the projecting leg 306 finally fits in the lower recess 428 and abuts against the partition 427. The connection portion 307 of the projecting leg 306 faces the upper recess 426 of the bar portion 425. Thus, an electrical connector assembly 1 is completed with a retaining frame 3 connecting two electrical connectors 2.

One feature of the present invention is that the electrical connector assembly 1 comprises a retaining frame 3 to connect two adjacent electrical connectors 2. The retaining frame 3 can provide a connection way due to its configuration. Thus, the electrical connectors 2 can stand firmly on the printed circuit board when it is mated with or unmated from a complementary electrical connector. It is noted that a space 8 (FIG. 8) is defined between the retaining frame 3 to accommodate electrical components of the printed circuit board.

Figure 10:
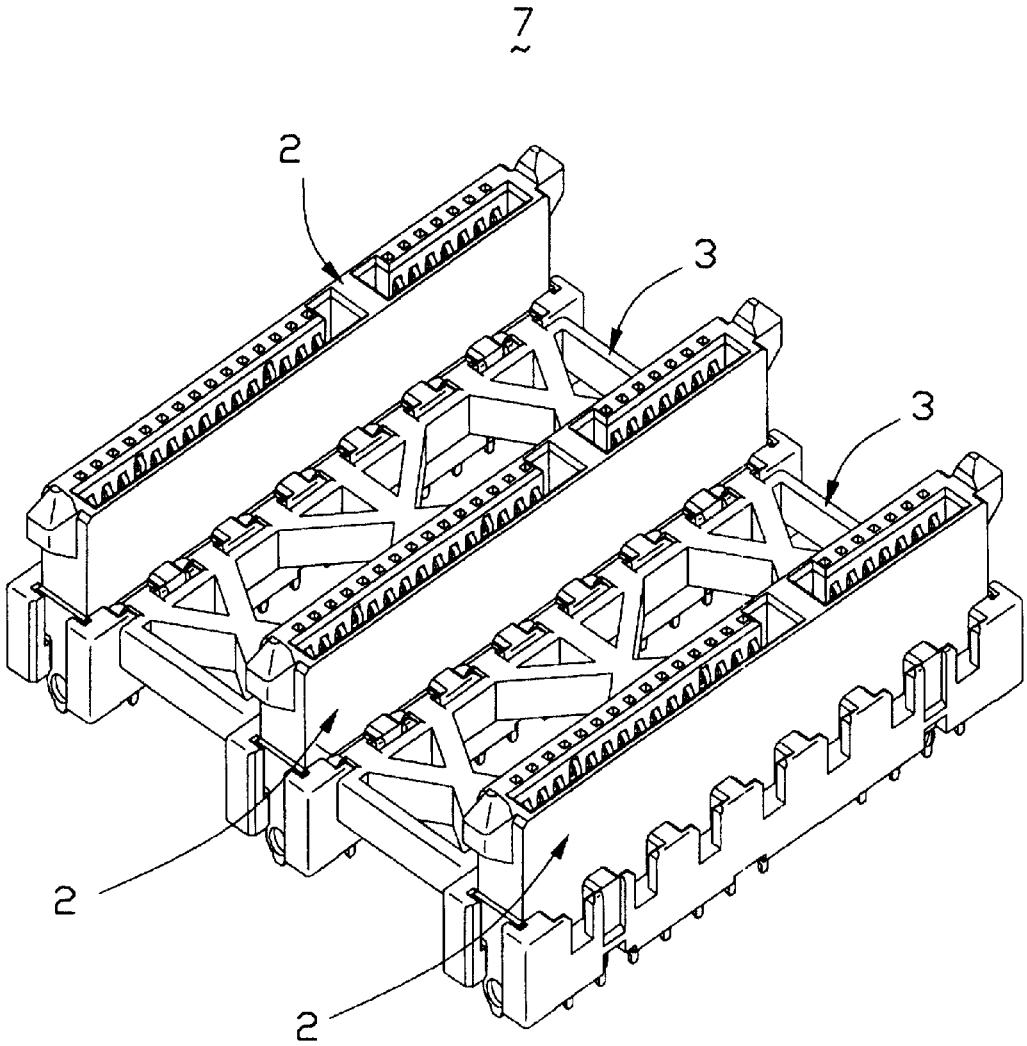
FIG. 10 is a perspective, assembled view of another electrical connector assembly in accordance with the present invention.

Understandably, although an electrical connector assembly comprising two electrical connectors is described, it should be appreciated that an electrical connector assembly comprising more than two electrical connectors can be configured by employing more connectors each having a configuration the same as the connector 2 and more retaining frames each having a configuration the same as the retaining frame 3. For example, FIG. 10 shows an electrical connector assembly 7 comprising three electrical connectors 2 being connected by two retaining frames 3.

In the preferred embodiment of the present invention, the retaining frame 3 and the electrical connectors 2 are separately molded. Of course, it's easily understood the persons skilled in the art that the retaining frame 3 can be integrally molded with the insulative housings 4 of the electrical connectors 2 when the number of the electrical connectors 2 needed is predetermined. When the insulative housings 4 of the electrical connectors 2 and the retaining frame 3 are integrally molded, the longitudinal sidewalls 30, the protrusions 300, and the projecting legs 306 of the retaining frame 3 may be eliminated, with only the plurality of transverse beams 34 connecting the mounting portions 42 of the neighboring electrical connectors 2 being required. Correspondingly, the T-shaped spaces 423, the upper recesses 426, and the lower recesses 428 of the insulative housing 4 of each electrical connector 2 are also not necessary.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

two electrical connectors each comprising an insulative housing and a plurality of conductive terminals received in the housing, the insulative housing comprising a mating portion having a pair of longitudinal sidewalls and a mounting portion having a pair of longitudinal sidewalls, each longitudinal sidewall of the mounting portion defining a plurality of spaces adjacent to a corresponding longitudinal sidewall of the mating portion and a plurality of bar portions separating the spaces; and a retaining frame connecting the two electrical connectors, the retaining frame having two longitudinal sidewalls and a plurality of protrusions projecting outwardly from the longitudinal sidewalls, the protrusions being received into corresponding spaces of neighboring longitudinal sidewalls of the mounting portions of the electrical connectors; wherein each space of the mounting portion of each electrical connector is T-shaped and is composed of a slot and a channel communicating with each other, in which the channel is wider than the slot and located closer to a corresponding longitudinal sidewall of a corresponding insulative housing; wherein each protrusion of the retaining frame is also T-shaped, and comprises a platform retained in the channel of a corresponding space of a corresponding electrical connector and a connection portion connecting the platform with a corresponding longitudinal sidewall of the retaining frame and fitting in the slot of the corresponding space; wherein the connection portion of each protrusion is narrower than the platform; wherein each of the bar portions adjacent opposite ends of the longitudinal sidewalls of the mounting portion of each electrical connector defines an upper recess and a lower recess in an outer surface thereof; wherein the upper recess and the lower recess have the same width and are separated by a partition; wherein each longitudinal sidewall of the retaining frame comprises a plurality of projecting legs extending downwardly therefrom, each projecting leg comprising a projection formed at a lower end and fitted in a corresponding lower recess and abutting against a corresponding partition, and a connection portion facing a corresponding upper recess; wherein the retaining frame is rectangular and comprises a pair of transverse sidewalls connecting opposite ends of the longitudinal sidewalls; wherein the retaining frame further comprises a plurality of beams connecting the longitudinal sidewalls together; wherein a plurality of cavities is defined between the beams for heat dissipation; wherein when the electrical connector assembly is mounted on a printed circuit board, a space is defined between the retaining frame and the printed circuit board to accommodate electrical components of the printed circuit board.

* * * * *